US008556743B2

(12) United States Patent
Forest

(10) Patent No.: US 8,556,743 B2
(45) Date of Patent: Oct. 15, 2013

(54) PUTTING PRACTICE DEVICE

(75) Inventor: Joseph Forest, Edmonton (CA)

(73) Assignee: Putting Cyclops Inc., St. Albert (CA)

( * ) Notice: Subject to any disclaimer, the term of this patent is extended or adjusted under 35 U.S.C. 154(b) by 283 days.

(21) Appl. No.: 13/083,367

(22) Filed: Apr. 8, 2011

(65) Prior Publication Data

US 2012/0088596 A1 Apr. 12, 2012

Related U.S. Application Data

(60) Provisional application No. 61/322,276, filed on Apr. 8, 2010.

(51) Int. Cl.
*A63B 69/36* (2006.01)

(52) U.S. Cl.
USPC ..... 473/261

(58) Field of Classification Search
USPC ..... 473/261, 257, 258, 268; D21/789, 791
See application file for complete search history.

(56) References Cited

U.S. PATENT DOCUMENTS

| | | | | | |
|---|---|---|---|---|---|
| 2,754,125 | A | | 7/1956 | Engler | |
| 3,510,136 | A | * | 5/1970 | Ruspoli | 473/137 |
| D245,035 | S | | 7/1977 | Gordon | |
| 4,082,287 | A | * | 4/1978 | Berkey | 473/261 |
| 4,129,301 | A | | 12/1978 | Kenney | |
| 4,765,624 | A | * | 8/1988 | Sprague | 473/268 |
| 5,007,646 | A | * | 4/1991 | Baber et al. | 473/261 |
| 5,503,395 | A | * | 4/1996 | Cook | 473/261 |
| D418,891 | S | | 1/2000 | Sirak | |
| 6,129,639 | A | * | 10/2000 | Brock et al. | 473/260 |
| 6,416,420 | B1 | | 7/2002 | Stark | |
| D470,906 | S | | 2/2003 | Shaw | |
| 6,746,339 | B1 | | 6/2004 | Thibaudeau | |
| 7,004,851 | B2 | | 2/2006 | Pierce | |
| 7,063,624 | B2 | * | 6/2006 | Baldwin, Jr. | 473/218 |
| D600,299 | S | | 9/2009 | Hanley | |
| D646,739 | S | * | 10/2011 | Forest | D21/791 |
| 2005/0282651 | A1 | * | 12/2005 | Pierce | 473/261 |
| 2012/0088596 | A1 | * | 4/2012 | Forest | 473/261 |

FOREIGN PATENT DOCUMENTS

| | | |
|---|---|---|
| CA | 2 620 927 A1 | 7/2009 |

* cited by examiner

*Primary Examiner* — Raleigh W Chiu
(74) *Attorney, Agent, or Firm* — Christensen O'Connor Johnson Kindness PLLC

(57) ABSTRACT

A putting practice device has a bottom support, side supports, a front plate, and a cover. The side supports are attached at opposed ends of the bottom support. Each side support has a top edge with a horizontally disposed sliding track. A front plate has a face that defines at least a portion of a desired travel path of a putter head. A cover has sliders that engage the sliding track of the side supports and the central support such that the top plate is slideably connected to each side support and to the central support. The cover has an extended portion that extends past the front plate and covers the at least a portion of the desired travel path. The position of the extended portion is adjustable by sliding the sliders along the sliding tracks.

33 Claims, 4 Drawing Sheets

PUTTING PRACTICE DEVICE

FIELD

This relates to a device for practicing and improving the putting skill of golfers.

BACKGROUND

Canadian Patent Application No. 2,620,927 (Hogan), entitled "A device to improve the putting skill of golfers," relates to a collapsible device that helps instill good putting habits in golfers.

SUMMARY

There is provided a putting practice device, comprising a bottom support, side supports, a front plate, and a cover. The side supports are attached at opposed ends of the bottom support. Each side support has a top edge with a horizontally disposed sliding track. A front plate has a face that defines at least a portion of a desired travel path of a putter head. A curvature of the front plate may be adjustable to modify the desired travel path. A cover has sliders that engage the sliding track of the side supports and the central support such that the cover is slideably connected to each side support and to the central support. The cover has an extended portion that extends past the front plate and covers the at least a portion of the desired travel path. The position of the extended portion is adjustable by sliding the sliders along the sliding tracks. Each sliding track may be one of a female sliding track or a male sliding track.

According to another aspect, there may be a central support disposed between the side supports that has a horizontally disposed sliding track that is engaged by a central slider on top plate. The central support may be integrally formed with the front plate. The side supports may be connected to the bottom support by hinges. The engagement of the sliders and the sliding tracks may provide structural support.

According to another aspect, the extended portion may be fully retractable or reversible. The extended portion of the cover may comprise a ball and putter head viewing port for viewing a golf ball and putter head. The golf ball viewing port may be symmetrical for viewing putter heads for left and right handed putters. There may be a viewing port cover for covering the viewing port.

BRIEF DESCRIPTION OF THE DRAWINGS

These and other features will become more apparent from the following description in which reference is made to the appended drawings. The drawings are for the purpose of illustration only and are not intended to be in any way limiting, wherein.

DETAILED DESCRIPTION

Figure 1:
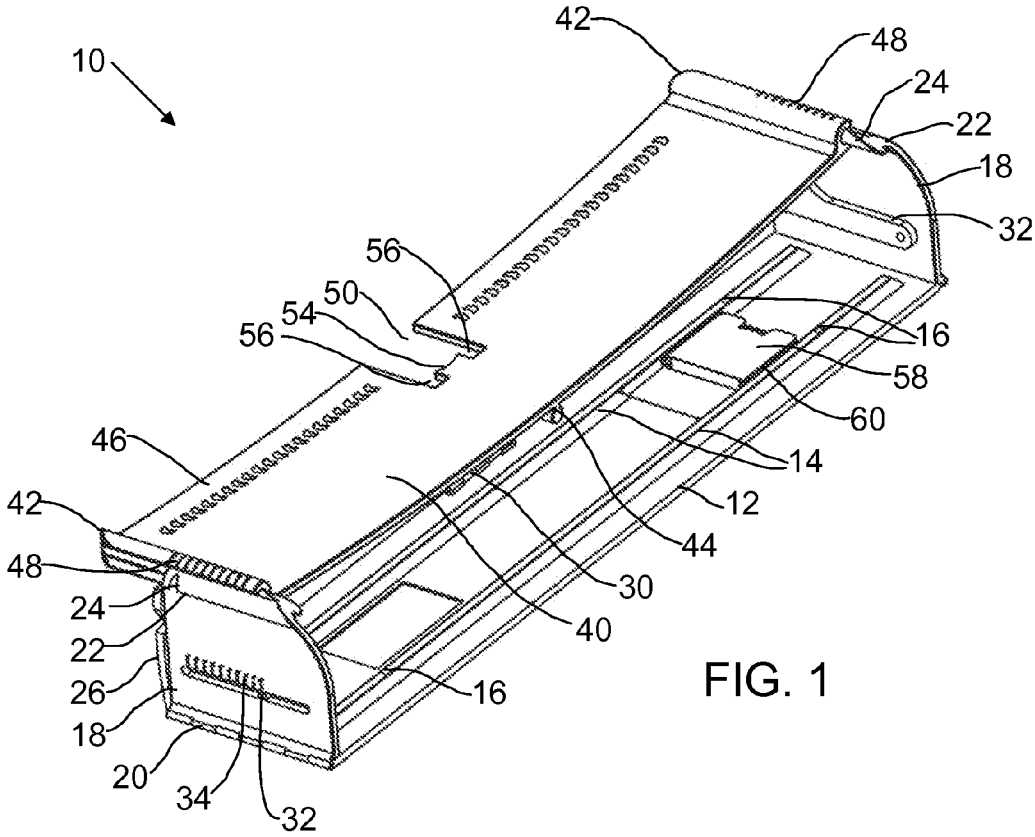
FIG. 1 is a rear perspective view of a putting practice device.

A putting practice device generally identified by reference numeral 10 will now be described with reference to FIGS. 1 through 7.

Structure and Relationship of Parts:

Referring to FIG. 1, putting practice device 10 has a bottom support 12 that is in the form of an elongated plate with structural ribs 14 to make it more rigid. Bottom support 12 also has holes 16 that are large enough to receive golf tees, which allows bottom support 12 to be secured to a ground surface. There are side supports 18 attached at opposed ends of bottom support 12. As shown, side supports 18 are attached by hinges, such as piano hinges 20, to allow them to be pivoted to a storage position (not shown). Each side support 18 has a top edge 22 with a horizontally disposed sliding track 24.

Figure 2:
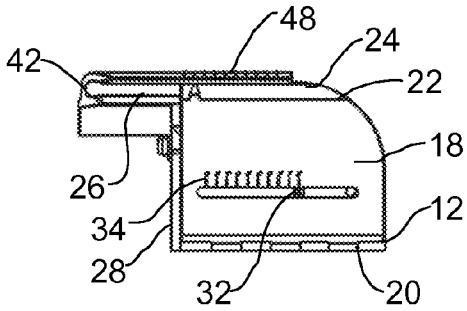
FIG. 2 is a side elevation view of the putting practice device.
Figure 3:
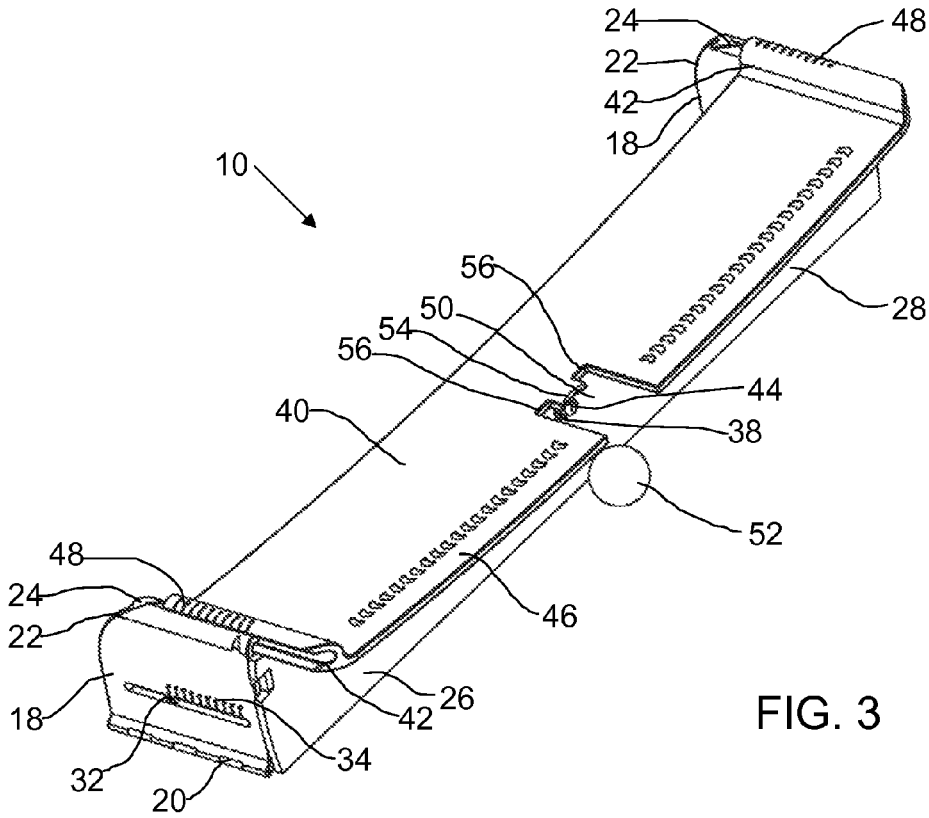
FIG. 3 is a front perspective view of the putting practice device.

Referring to FIG. 3, along the front edge of bottom support 12 is a front plate 26 that has a face 28 that defines at least a portion of a desired travel path of a putter head. In the depicted embodiment, front plate 26 is attached to bottom support 12 by a piano hinge 30 (shown in FIG. 1) that is substantially centered along bottom support 12 and front plate 26. Front plate 26 is also attached to side supports 18 by an adjustable bracket 32. Referring to FIG. 2, adjustable bracket 32 and piano hinge 30, which acts as an anchor point, allow the curvature of face 28 to be adjusted to define a straight putting stroke, a straight back to inside putting stroke, or an inside to straight through putting stroke by moving adjustable bracket 32 to the desired setting on the scale 34. Accordingly, front plate 26 is preferably made from a flexible or resilient material, such as plastic, that allows it to be deformed and return to its original position.

Figure 4:
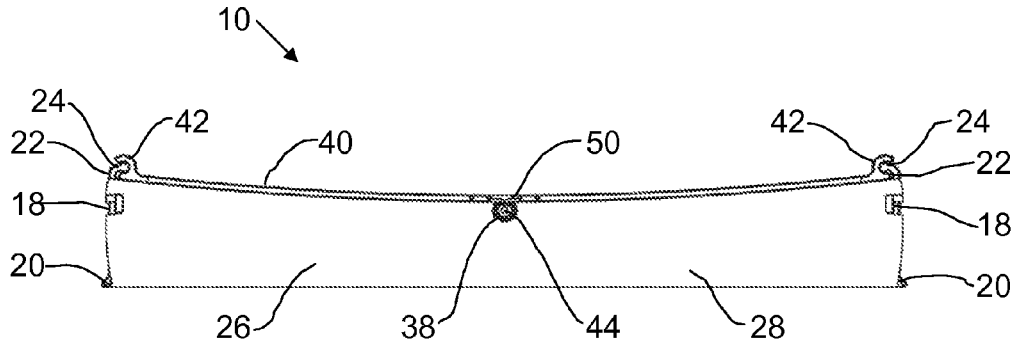
FIG. 4 is a front elevation view of the putting practice device.
Figure 5:
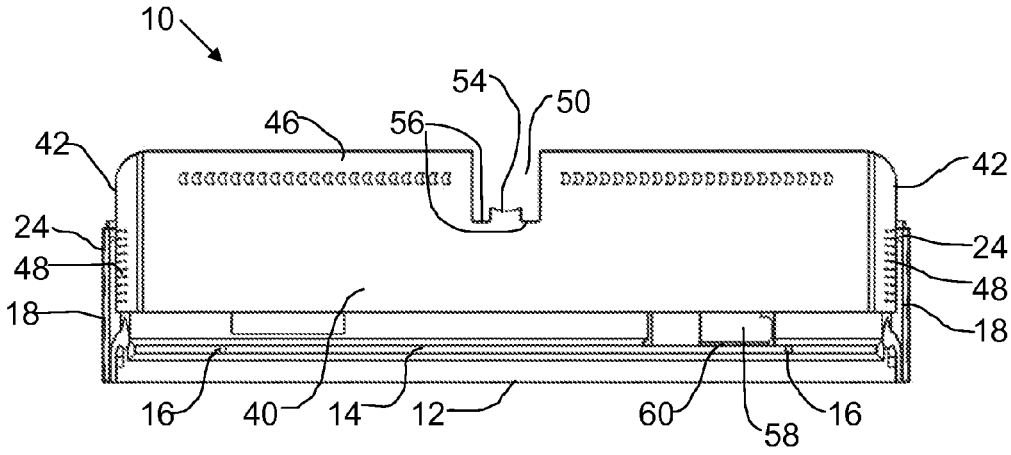
FIG. 5 is a top plan view of the putting practice device.

Referring to FIG. 4, front plate 26 is also has an integrally formed central support 36 that has a horizontally disposed sliding track 38 that is disposed between side supports 18. Sliding tracks 24 and 38 may be male or female sliding tracks. As shown, sliding tracks 24 are male tracks, and sliding track 38 is a female track. In other embodiments, central support 36 may not be integrally formed with front plate 26. Central support 36 provides additional stability to the structure of putting practice device 10. A cover 40 has side sliders 42 and a central slider 44 that engage sliding tracks 24 of side supports 18 and sliding track 38 of central support 36, respectively. The engagement between sliding tracks 24 and 38 and sliders 42 and 44 provides structural support to device 10, as well as allowing cover 40 to be slideably connected to each side support 18 and to central support 36. Referring to FIG. 4, cover 40 has an extended portion 46 that extends past front plate 36 and covers the putter travel path to help train the eye of a putter to avoid looking at the putter during the putting stroke. Sliding tracks 24 and 38 and sliders 42 and 44 allow the extension of extended portion 46 to be adjusted, which allows putting practice device 10 to be used with different types of putters without interfering with the putter. For example, belly putters have the putter shaft close to the center of the putter head compared to traditional putters. This requires a shorter extended portion 46 to allow the toe of the club to be guided by face 28. There is a scale 48 on either end to help the user recall and select the proper setting on subsequent uses. As cover 40 is connected by sliders, it may also be quickly adjusted using the golfer's foot if necessary. Extended portion 46 of cover 40 may be fully retractable or, as shown in FIG. 5, reversible. This gives the user the option to practice putting with or without extended portion 46 in place, or to minimize the size of device 10 without disassembling it.

Referring to FIG. 2, extended portion 46 of top plate 40 has a ball and putter head viewing port 50 that allows the user to see a golf ball 52 and putter head (not shown). As shown, viewing port 50 has a rounded central portion 54 for proper placement of golf ball 52 and side slots 56 for proper placement of the putter head. Viewing port 50 is symmetrical with two side slots 56 on either side of rounded central portion 54, which allows device 10 to be used by left- or right-handed golfers.

In some circumstances, it may be desired to train without seeing golf ball 52. For example, putting without being able to see golf ball 52 may help a golfer who is suffering from the "yips," which is generally considered to be a nervous condition that causes a golfer to fail. Accordingly, referring to FIG. 7, a viewing port cover 58, or "yips clip," may be provided that can be used to cover viewing port 50. Viewing port cover 58 may be stored in a cavity 60 on bottom support 12 when not in use, as shown in FIG. 1.

Operation:

Referring to FIGS. 1 and 3, putting practice device 10 may be designed to collapse for storage and transport, in which case device 10 is assembled by pivoting end supports 18 and front plate 26 about piano hinges 20 and 30 into the desired orientation. Cover 40 is then installed by engaging sliders 48 with slider channels 24 on end supports 18 and slider 44 with slider channel 38 on front plate 26. At this point, device 10 is in a stable structure.

Bottom support 12 is installed in the desired location on a practice green, for example, by inserting tees or other anchors through holes 16 to fix its position once properly aligned at the desired distance from the hole or other target. If device 10 is used on a hard surface such as an indoor surface, such that tees cannot be used, other anchors may be provided, such as a non-slip surface, additional weights, etc., as will be known in the art. Brackets 32 may then be adjusted to have front plate 26 define the desired travel path for the putter head. Cover 40 is then slid in or out along slider channels 24 and 38 to properly position extended portion 46 based on the putter to be used and the preferences of the user. Once the position of bottom support 12, front plate 26 and cover 40 are selected, golf ball 52 is positioned such that the user sees ball 52 through view port 50 when viewed from above. The curved portion 54 of view port 50 provides a guide as to where ball 52 should be positioned, while side slots 56 provide a guide for the putter. The putter swing is then initiated with a backswing that follows front plate 26, followed by the swing and backswing, which also follows front plate 26, even after contacting the ball to ensure a proper follow-through. Adjustments may be made as needed by the user. The preferred adjustments may be noted on scales 34 and 48, such that the user may compare techniques or recall what settings were used previously.

Figure 6:
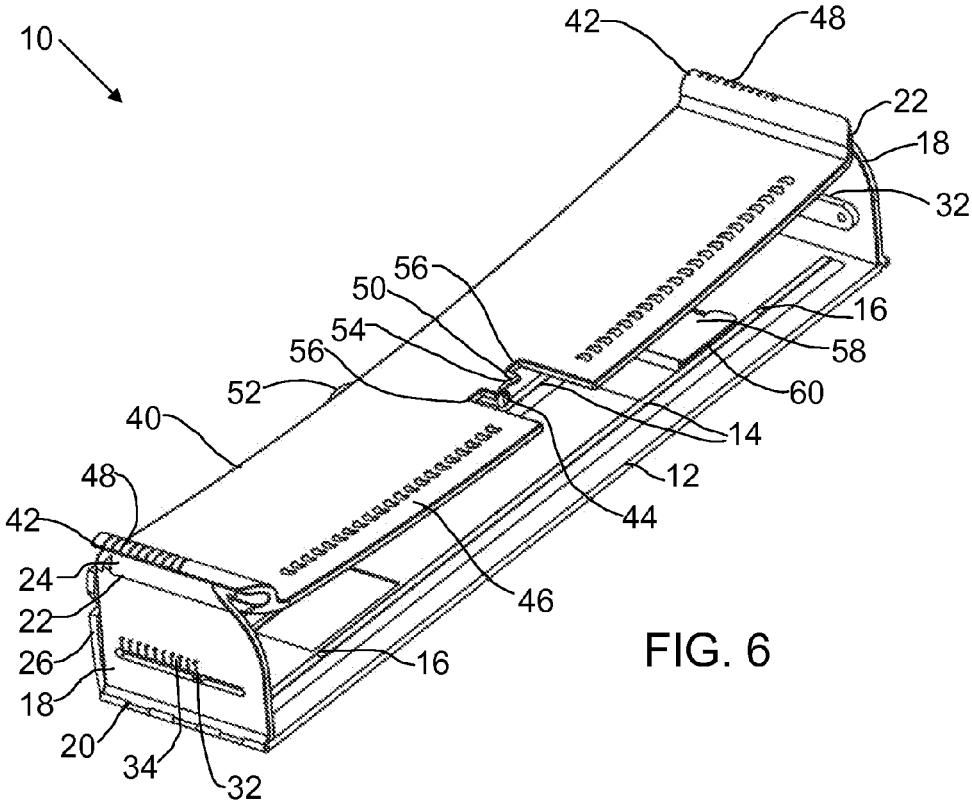
FIG. 6 is a rear perspective view of the putting practice device with the top plate in a reversed position.
Figure 7:
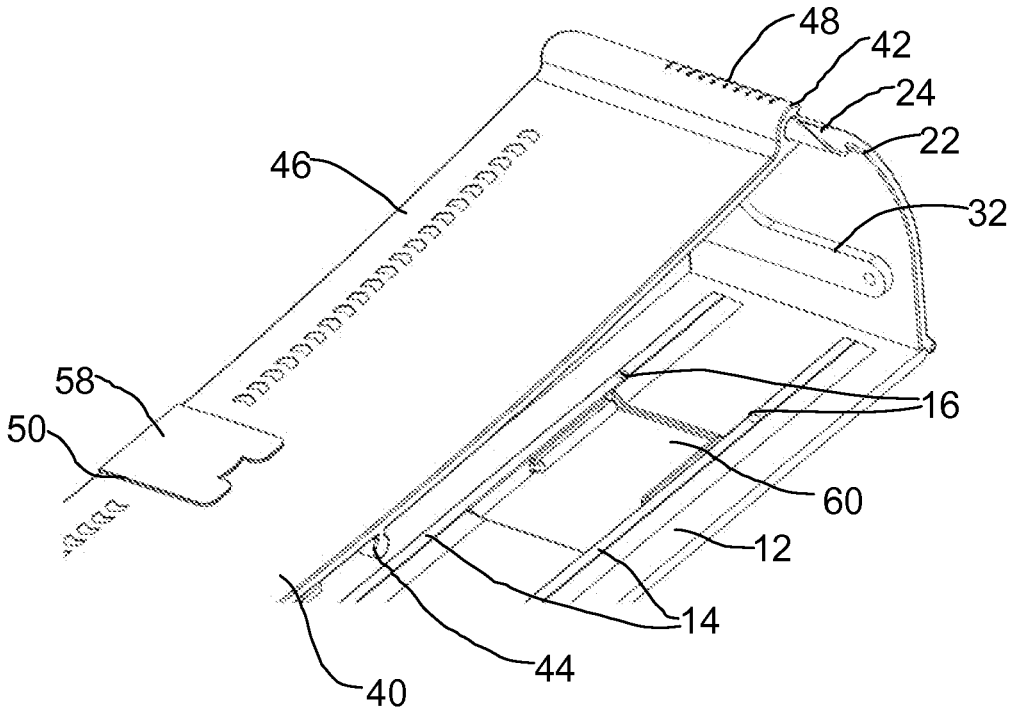
FIG. 7 is a detailed rear perspective view of the putting practice device with a cover over the viewing port.

Referring to FIG. 6, cover 40 may be reversed to allow the user an unobstructed view of the entire swing, while still having the putter head follow front plate 26 to ensure a proper swing path. Alternatively, referring to FIG. 7, cover 58 may be placed over view port 50 to prevent the user from seeing the ball at all during the swing, which may be beneficial when trying to overcome the "yips."

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. A putting practice device, comprising:

a bottom support;

side supports attached at opposed ends of the bottom support, each side support having a top edge with a horizontally disposed sliding track;

a central support disposed between the side supports, the central support having a horizontally disposed sliding track;

a front plate having a face that defines at least a portion of a desired travel path of a putter head; and a cover having sliders that engage the sliding track of the side supports and a central slider that engages the central support such that the top plate is slideably connected to each side support and to the central support, the cover having an extended portion that extends past the front plate and covers the at least a portion of the desired travel path, the position of the extended portion being adjustable by sliding the sliders along the sliding tracks.

2. The putting practice device of claim 1, wherein the extended portion is fully retractable.

3. The putting practice device of claim 1, wherein the extended portion is reversible.

4. The putting practice device of claim 1, wherein the side supports are connected to the bottom support by hinges.

5. The putting practice device of claim 1, wherein the central support is integrally formed with the front plate.

6. The putting practice device of claim 1, wherein the engagement of the sliders and the sliding tracks provides structural support.

7. The putting practice device of claim 1, wherein the extended portion of the cover comprises a ball and putter head viewing port for viewing a golf ball and putter head.

8. The putting practice device of claim 7, wherein the viewing port is symmetrical for viewing putter heads for left- and right-handed putters.

9. The putting practice device of claim 7, comprising a viewing port cover for covering the viewing port.

10. The putting practice device of claim 1, wherein a curvature of the front plate is adjustable to modify the desired travel path.

11. The putting practice device of claim 1, wherein each sliding track is one of a female sliding track or a male sliding track.

12. A putting practice device, comprising:

a bottom support;

side supports attached at opposed ends of the bottom support, each side support having a top edge with a horizontally disposed sliding track;

a front plate having a face that defines at least a portion of a desired travel path of a putter head; and a cover having sliders that engage the sliding track of the side supports such that the top plate is slideably connected to each side support, the cover having an extended portion that extends past the front plate and covers the at least a portion of the desired travel path, the position of the extended portion being adjustable by sliding the sliders along the sliding tracks, the extended portion having a retracted position that is behind the face of the front plate.

13. The putting practice device of claim 12, further comprising a central support disposed between the side supports, the central support having a horizontally disposed sliding track that is engaged by a central slider on the top plate.

14. The putting practice device of claim 13, wherein the central support is integrally formed with the front plate.

15. The putting practice device of claim 12, wherein the extended portion is reversible.

16. The putting practice device of claim 12, wherein the side supports are connected to the bottom support by hinges.

17. The putting practice device of claim 12, wherein the engagement of the sliders and the sliding tracks provide structural support.

18. The putting practice device of claim 17, comprising a viewing port cover for covering a viewing port.

19. The putting practice device of claim 12, wherein the extended portion of the cover comprises a ball and putter head viewing port for viewing a golf ball and putter head.

20. The putting practice device of claim 19, wherein the viewing port is symmetrical for viewing putter heads for left and right handed putters.

21. The putting practice device of claim 12, wherein a curvature of the front plate is adjustable to modify the desired travel path.

22. The putting practice device of claim 12, wherein each sliding track is one of a female sliding track or a male sliding track.

23. A putting practice device, comprising:

a bottom support;

side supports attached at opposed ends of the bottom support, each side support having a top edge with a horizontally disposed sliding track;

a front plate having a face that defines at least a portion of a desired travel path of a putter head, the curvature of the front plate being adjustable to modify the at least a portion of the desired travel path; and a cover having sliders that engage the sliding track of the side supports such that the top plate is slideably connected to each side support, the cover having an extended portion that extends past the front plate and covers the at least a portion of the desired travel path, the position of the extended portion being adjustable by sliding the sliders along the sliding tracks.

24. The putting practice device of claim 23, further comprising a central support disposed between the side supports, the central support having a horizontally disposed sliding track that is engaged by a central slider on the top plate.

25. The putting practice device of claim 24, wherein the central support is integrally formed with the front plate.

26. The putting practice device of claim 23, wherein the extended portion is fully retractable.

27. The putting practice device of claim 23, wherein the extended portion is reversible.

28. The putting practice device of claim 23, wherein the side supports are connected to the bottom support by hinges.

29. The putting practice device of claim 23, wherein the engagement of the sliders and the sliding tracks provide structural support.

30. The putting practice device of claim 29, comprising a viewing port cover for covering a viewing port.

31. The putting practice device of claim 23, wherein the extended portion of the cover comprises a ball and putter head viewing port for viewing a golf ball and putter head.

32. The putting practice device of claim 31, wherein the viewing port is symmetrical for viewing putter heads for left and right handed putters.

33. The putting practice device of claim 23, wherein each sliding track is one of a female sliding track or a male sliding track.

* * * * *